US006439841B1

(12) United States Patent
Bosel

(10) Patent No.: US 6,439,841 B1
(45) **Date of Patent: *Aug. 27, 2002**

(54) TURBINE FRAME ASSEMBLY

(75) Inventor: Tod Kenneth Bosel, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/561,773

(22) Filed: Apr. 29, 2000

(51) Int. Cl.[7] ..... F01D 25/16

(52) U.S. Cl. ..... 415/142; 415/189; 415/209.3; 415/209.4

(58) Field of Search ..... 415/142, 180, 415/189, 190, 115, 116, 174, 177, 178, 176, 175, 209.4, 209.3; 60/39.31

(56) References Cited

U.S. PATENT DOCUMENTS

| | | | | |
|---|---|---|---|---|
| 3,836,282 A | * | 9/1974 | Mandelbaum et al. | 415/209.4 |
| 4,385,864 A | * | 5/1983 | Zacherl | 415/209.3 |
| 5,224,341 A | * | 7/1993 | Munroe et al. | 415/189 |
| 5,272,869 A | | 12/1993 | Dawson et al. | 415/142 |
| 5,273,397 A | | 12/1993 | Czachor et al. | 415/178 |
| 5,292,227 A | | 3/1994 | Czachor et al. | 415/142 |
| 5,438,756 A | | 8/1995 | Halchak et al. | |
| 5,483,792 A | | 1/1996 | Czachor et al. | 60/39.31 |
| 5,609,467 A | * | 3/1997 | Lenhart et al. | 415/142 |
| 5,634,767 A | | 6/1997 | Dawson | 415/209.3 |

FOREIGN PATENT DOCUMENTS

| | | | | |
|---|---|---|---|---|
| GB | 2084261 A | * | 4/1982 | 415/189 |

* cited by examiner

*Primary Examiner*—F. Daniel Lopez
*Assistant Examiner*—Richard Woo
(74) *Attorney, Agent, or Firm*—Nathan D. Herkamp; Steven J. Rosen

(57) ABSTRACT

An annular turbine frame has ring disposed coaxially about an axial centerline axis and includes a plurality of circumferentially spaced apart ports. A plurality of circumferentially spaced apart struts are joined radially to the ring by devises on the ring. Each strut has radially opposite first and second ends, and a through channel extending therebetween. Each of the channels is aligned with a corresponding one of the ports. Each of the ports has a port counterbore though a radially outer portion of the port forming a shoulder in the port. A seal is disposed within the port counterbore between the shoulder and the strut.

17 Claims, 7 Drawing Sheets

TURBINE FRAME ASSEMBLY

BACKGROUND OF THE INVENTION

1. Field of the Invention

The present invention relates generally to gas turbine engines and, more specifically, to frames therein for supporting bearings and shafts.

2. Discussion of the Background Art

Gas turbine engines include one or more rotor shafts supported by bearings which, in turn, are supported by annular frames. Frames include an annular casing spaced radially outwardly from an annular hub, with a plurality of circumferentially spaced apart struts extending therebetween. The struts may be integrally formed with the casing and hub in a common casting, for example, or may be suitable bolted thereto. In either configuration, the overall frame must have suitable structural rigidity for supporting the rotor shaft to minimize deflections thereof during operation.

The struts have a hollow cross section through which pressurized cooling air passes and is routed into a hub. The pressurized air provides rotor purge for the high pressure and low pressure turbines through holes in the hub. The air also provides cooling for the strut and hub in addition to tubes contained within the struts which service the aft high pressure turbine (HPT) bearing. It is important that the pressurized air within the strut and hub not be lost due to leakage. If leakage occurs, the rotor cavity temperatures will be adversely affected.

One example of a bolted turbine frame assembly is a GE90 turbine center frame (TCF) which has an outer strut end connected to the outer case by eight bolts at each of the twelve strut ends. To minimize relative movement between the case and strut end, a shear bolt is used at each location which bounds off the hole in the case and strut end. To assure concentricity between the case hole and strut hole during manufacture, each strut is located relative to the case and each hole is machined through the case and strut in a single pass. The struts are then separated from the case and each previously machined through hole is used as a pilot to machine a counterbore feature for subsequent thread tapping and insert installation.

The struts are connected to the hub with a clevis and with 2 expandable bolts which provide a secure shear connection preventing any relative motion between the strut and hub. The struts have a hollow cross section through which pressurized air passes and is routed into the hub. The pressurized air provides rotor purge for the high pressure and low pressure turbines through holes in the hub box. The air also provides cooling for the strut and hub in addition to tubes contained within the hollow struts which service the aft high pressure turbine (HPT) bearing. It is important that the pressurized air within the strut and hub not be lost due to leakage. If leakage occurs, the rotor cavity temperatures will be adversely affected. Since the expandable bolts do not seal the strut to the hub it is desirable to prevent leakage of the pressurized air between the struts and the hub.

SUMMARY OF THE INVENTION

An annular turbine frame has ring disposed coaxially about an axial centerline axis and includes a plurality of circumferentially spaced apart ports. A plurality of circumferentially spaced apart struts are joined radially to the ring by clevises on the ring. Each strut has radially opposite first and second ends, and a through channel extending therebetween. Each of the channels is aligned with a corresponding one of the ports. Each of the ports has a port counterbore though a radially outer portion of the port forming a shoulder in the port. A seal is disposed within the port counterbore between the shoulder and the strut.

BRIEF DESCRIPTION OF THE DRAWINGS

The novel features believed characteristic of the present invention are set forth and differentiated in the claims. The invention is more particularly described in conjunction with the accompanying drawings in which:

DETAILED DESCRIPTION

While there have been described herein what are considered to be preferred and exemplary embodiments of the present invention, other modifications of the invention shall be apparent to those skilled in the art from the teachings herein and, it is therefore, desired to be secured in the appended claims all such modifications as fall within the true spirit and scope of the invention.

Figure 1:
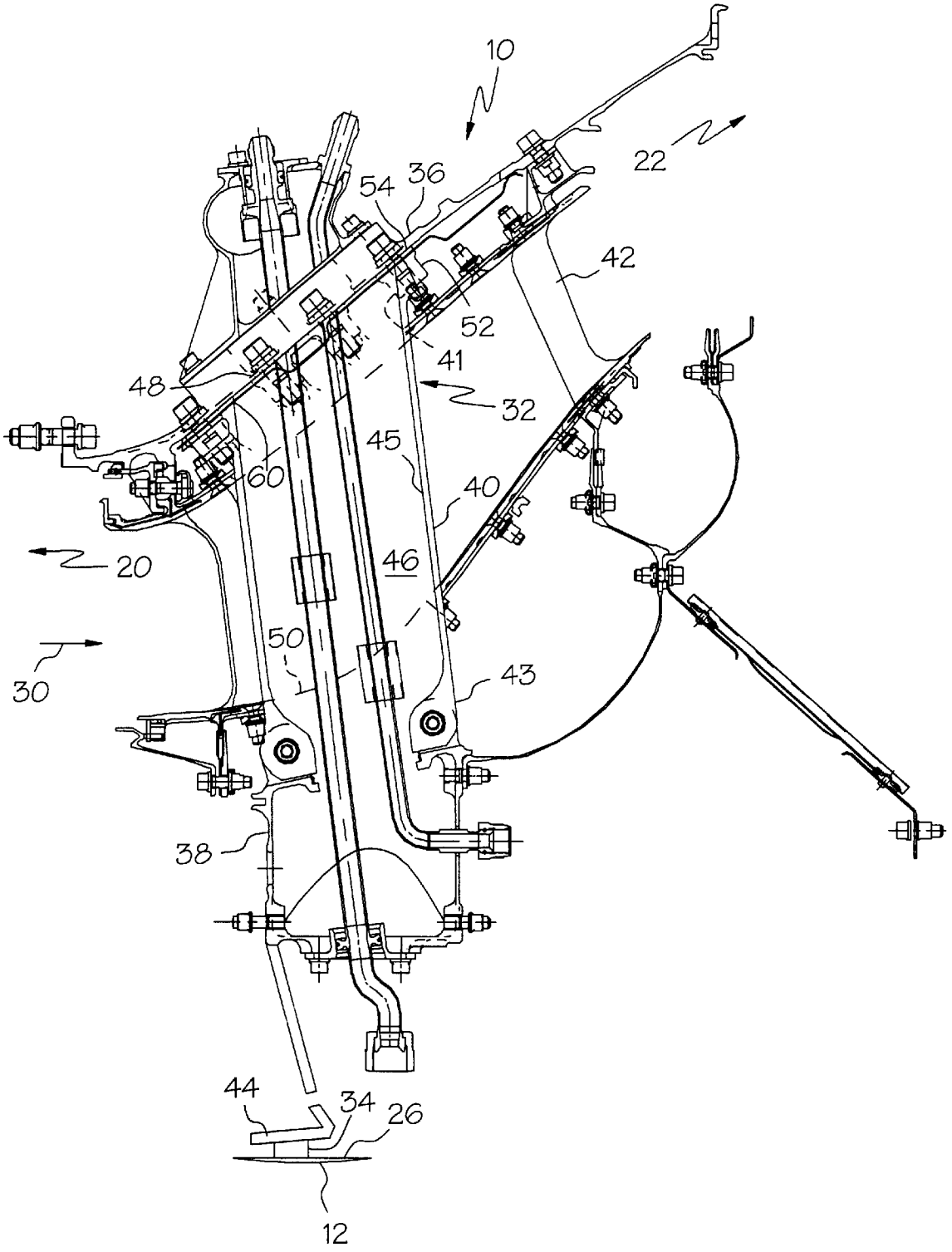
FIG. 1 is a longitudinal cross-sectional view illustration of a portion of a gas turbine engine having a turbine center frame assembly of an exemplary embodiment of the present invention.

Illustrated schematically in FIG. 1 is a portion of an exemplary gas turbine engine 10 having an axial or longitudinal centerline axis 12. Disposed about the centerline axis 12 in serial flow communication are a fan, compressor, and combustor (all not shown), high pressure turbine (HPT) 20 and low pressure turbine (LPT) 22. A first shaft (not shown) joins the compressor to the HPT 20, and a second shaft 26 joins the fan to the LPT. During operation, air enters the fan, a portion of which is compressed in the compressor to flow to the combustor wherein it is mixed with fuel and ignited for generating combustion gases 30 which flow downstream through the HPT 20 and the LPT which extract energy therefrom for rotating the first and second shafts.

An annular turbine frame 32, illustrated as a turbine center frame in accordance with one embodiment of the present invention, supports a bearing 34 which, in turn, supports one end of the second shaft 26 for allowing rotation thereof. Turbine frames are also used to support aft ends of the HPT shaft (not shown). The turbine frame 32 is disposed downstream of the HPT 20 and, therefore, must be protected from the combustion gases 30 which flow therethrough.

Figure 2:
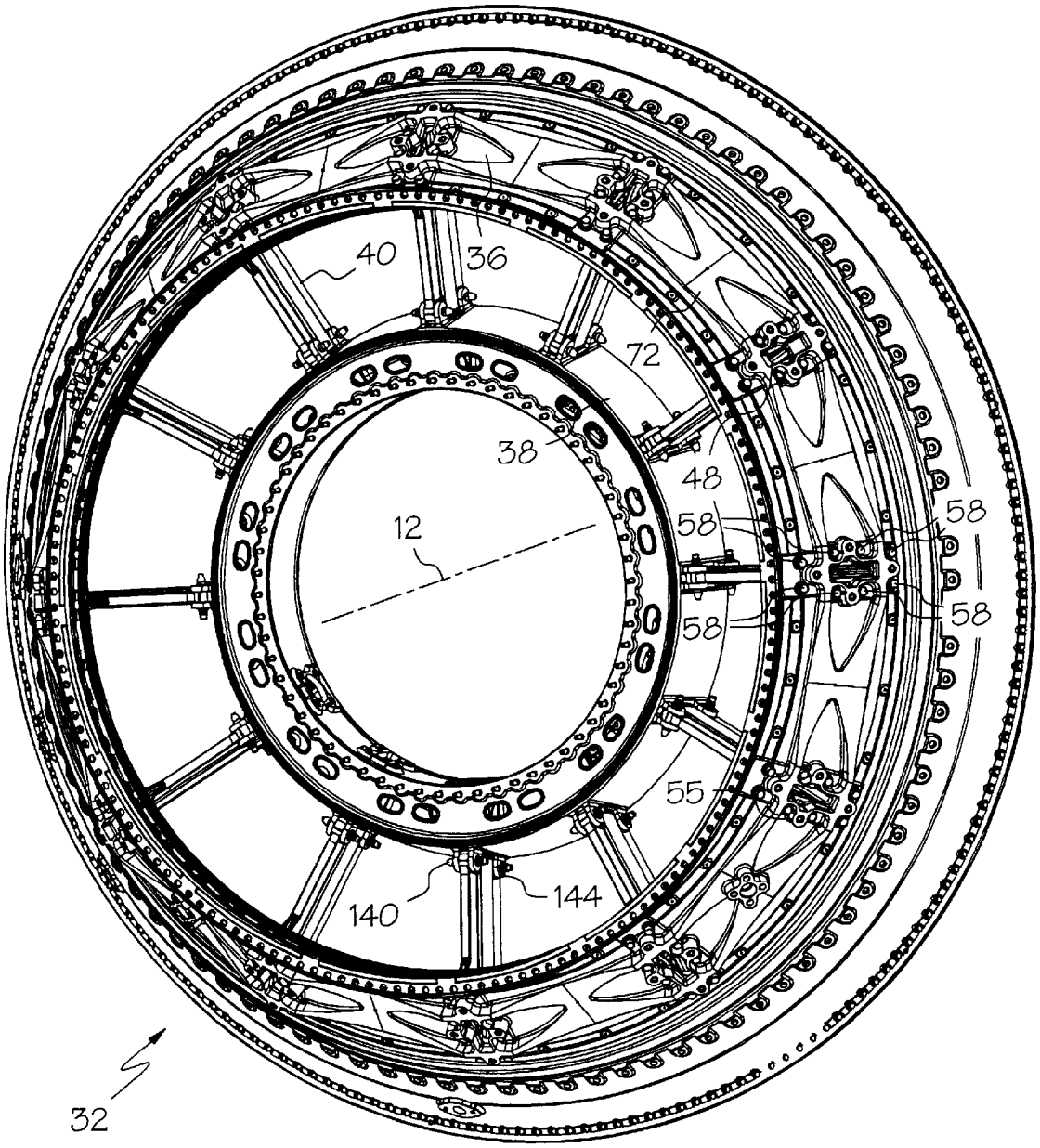
FIG. 2 is a perspective view illustration of the turbine center frame assembly in FIG. 1.

The turbine frame 32 as illustrated in FIGS. 1 and 2 includes a radially outer first structural ring, illustrated as a casing 36 for example, disposed coaxially about the centerline axis 12. The frame 32 also includes a radially inner second structural ring illustrated as a hub 38, for example, disposed coaxially with the first ring or casing 36 about the centerline axis 12 and spaced radially inwardly therefrom. A plurality of circumferentially spaced apart hollow struts 40 extend radially between the casing 36 and the hub 38 and are removably fixedly joined thereto.

The frame 32 also includes a plurality of conventional fairings 42 each of which surrounds a respective one of the struts 40 for protecting the struts from the combustion gases 30 which flow through the turbine frame 32. A generally conical sump member 44 which supports the bearing 34 in its central bore is joined to the hub 38. Each of the struts 40 includes a first or outer end 41 and a radially opposite second or inner end 43 with an elongate center portion 45 extending therebetween. The strut 40 is hollow and includes a through channel 46 extending completely through the strut 40 from the outer end 41 and through the center portion 45 to the inner end 43.

The casing 36 includes a plurality of circumferentially spaced apart first ports 48 extending radially therethrough and the hub 38 includes a plurality of circumferentially spaced apart second ports 50 extending radially therethrough. In the exemplary embodiment illustrated herein, the inner ends 43 of the struts 40 are removably fixedly joined to the hub 38 with a bolted connection, other embodiments have the inner ends 43 of the struts 40 fixedly attached with welding to or integrally formed with the hub 38 in a common casting. In this embodiment, the outer ends 41 of the struts 40 are removably fixedly joined to the casing 36. In alternate embodiments, the strut outer ends 41 may be integrally joined to the casing 36 in a common casting, for example, with the strut inner ends 43 being removably joined to the hub 38 also in accordance with the present invention.

A plurality of collars 52 surround and are integrally formed with the strut outer ends 41 and removably join the strut outer ends 41 to the casing 36. Though the collar 52 is illustrated as being integrally formed with the strut outer end 41, the collar can be separate in the form of a clevis as disclosed in U.S. Pat. Nos. 5,292,227 and 5,438,756 which are incorporated herein by reference. The collar 52 removably joins the strut outer ends 41 to the casing 36. In alternative embodiments (not shown), collars 52 may be used to removably join the inner ends 43 to the hub 38. In either configuration, each of the collars 52 is disposed between a respective one of the strut outer and inner ends 41, 43 and the respective ring, i.e. casing 36 or hub 38, in alignment with respective ones of the first or second ports 48, 50 for removably joining the struts 40 to the first or second ring, i.e. casing 36 or hub 38, for both carrying loads and providing access therethrough.

Figure 3:
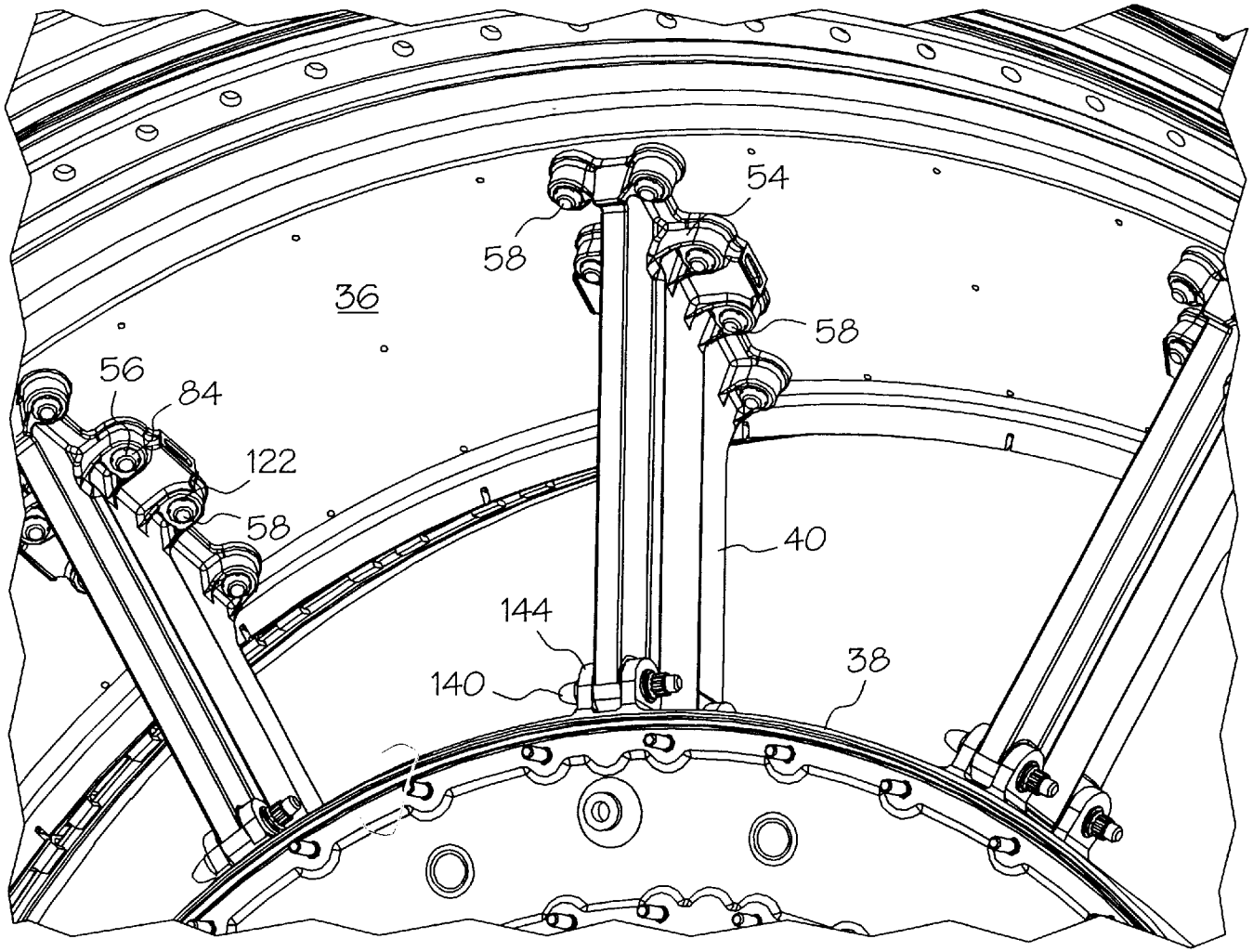
FIG. 3 is a perspective view illustration of a strut and casing inside of the turbine center frame assembly in FIG. 2.
Figure 4:
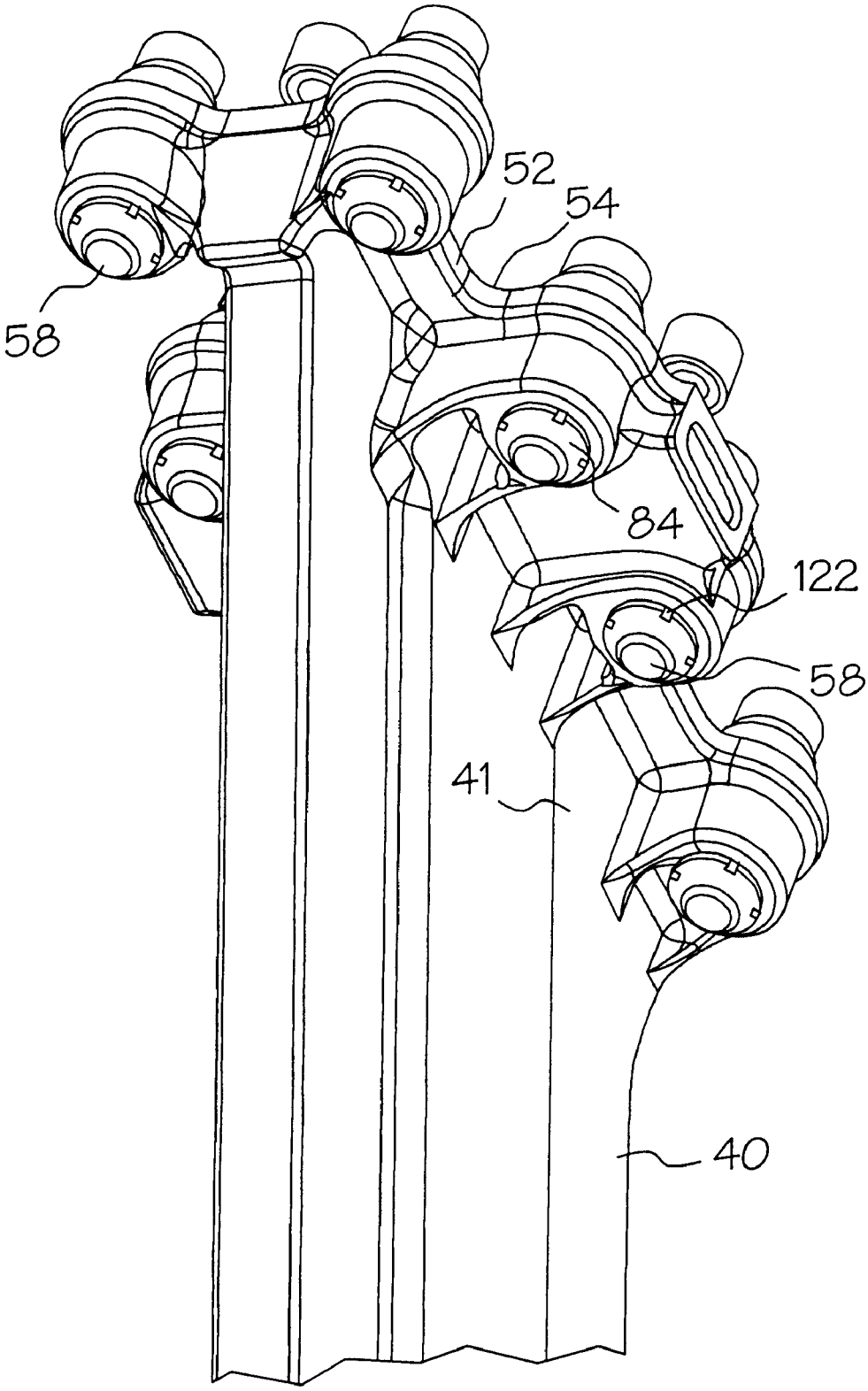
FIG. 4 is a radially outwardly looking perspective view illustration of a radially outer end of the strut in FIG. 3.

In the exemplary embodiment, referring to FIG. 3, each of the collars 52 is an arcuate base 54 disposed against the inner circumference of the casing 36. A plurality of casing holes 55 are aligned with a plurality of collar mounting holes 56 in the base 54, eight of each hole being shown for example, for receiving a respective plurality of mounting bolts 58, therethrough to removably fixedly join the base 54 to the casing 36. The base 54 includes a central aperture 60 aligned with a respective one of the first ports 48.

Referring back to FIG. 2, the casing 36 includes a pair of axially spaced apart, annular stiffening ribs 72 disposed on opposite, axial sides of the collars 52 and the first ports 48 for carrying loads between the struts 40 and the casing 36. The stiffening ribs 72 are continuous and uninterrupted annular members which carry loads in the hoop-stress direction without interruption by either the ports 48 or the struts 40 joined to the casing 36 so that loads may be transmitted from the hub 38 through the struts 40 and through the collars 52 to the casing 36, with the stiffening ribs 72 ensuring substantially rigid annular members to which the struts 40 are connected.

Referring to FIGS. 3, 4, 6, and 7, the base 54 is rigidly mounted to the casing 36 by the eight mounting bolts 58, thus, rigidly connecting the strut 40 by way of the strut outer end 41 to the casing. Each collar mounting hole 56 through the arcuate base 54 of the collar 52 includes a hole counterbore 80 though a radially outer portion 82 of the mounting hole. A threaded hollow insert 84 having inner and outer threaded surfaces 86 and 88, respectively, is used to secure the mounting bolt 58. A radially inner portion 90 of the collar mounting hole 56 is threaded to receive and hold the insert 84 disposed therein. A washer 94 is disposed in the counterbore 80 with a press fit. The mounting bolts 58 are disposed through the in line-drilled casing holes 55, washer 94, and mounting holes 56 and screwed into the threaded inner surface 86 of the insert 84. This assembly allows an assembler to screw in and tighten the bolts 58 from radially outboard of the casing 36 instead of radially inboard of the casing in a difficult to access area of the frame between the base 54 and the strut outer end 41.

Figure 6:
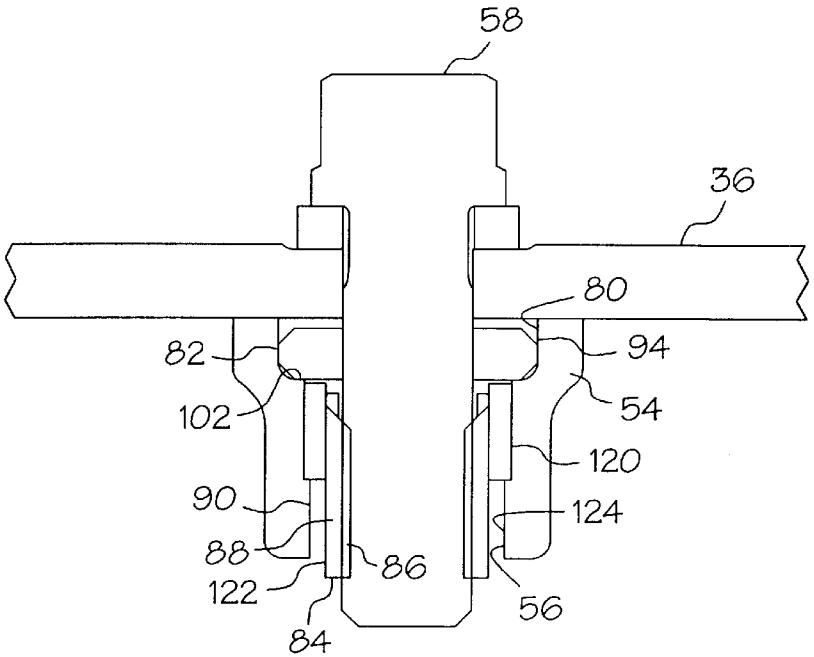
FIG. 6 is a cross-sectional view illustration of a portion of the casing and strut assembly taken though a bolt and threaded in an insert and a key used to secure the insert in a mounting hole in a strut base illustrated in FIG. 5.
Figure 5:
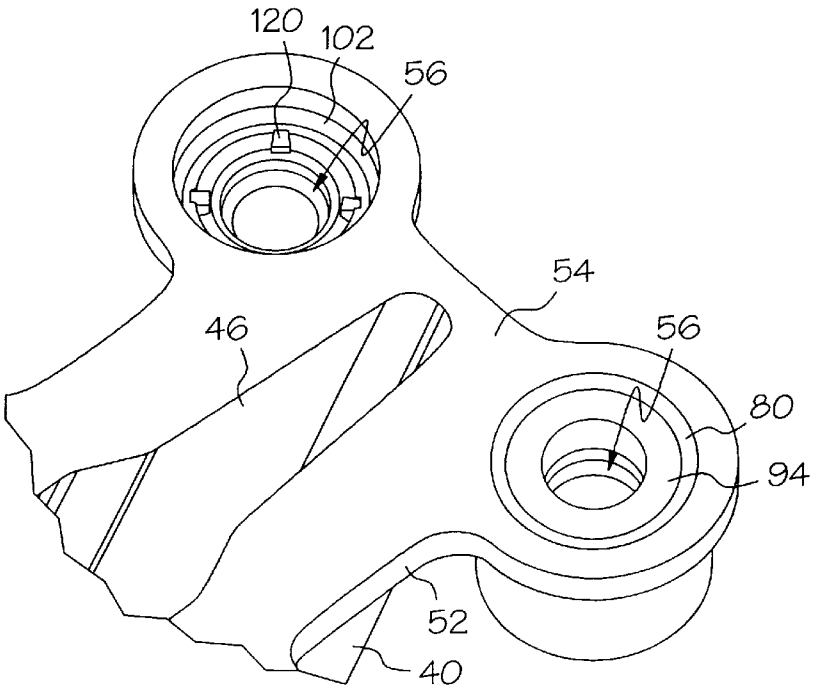
FIG. 5 is a radially inwardly looking perspective view illustration of a radially outer end of the strut in FIG. 3.
Figure 7:
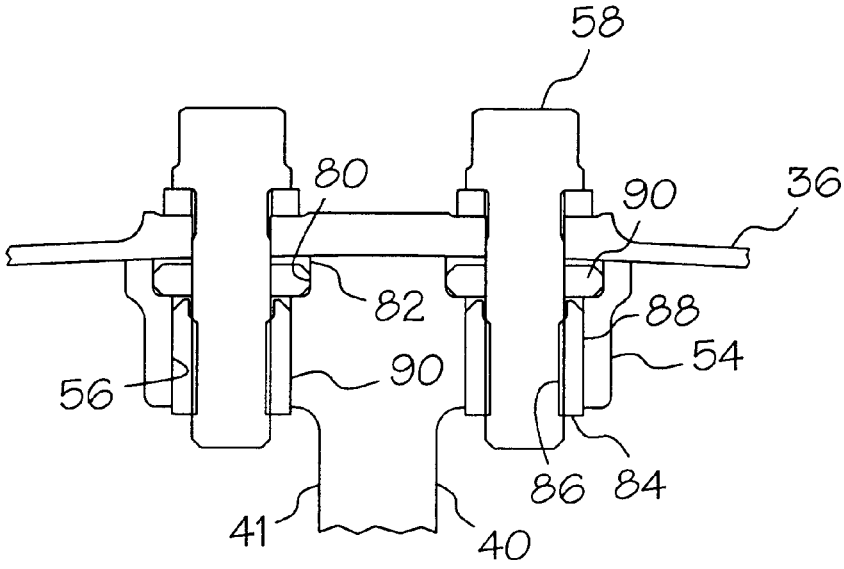
FIG. 7 is a cross-sectional view illustration of a portion of the casing and strut assembly taken though a bolt and threaded in the insert in the mounting hole in the strut base illustrated in FIG. 5.

The mounting bolts 58 seals off the mounting holes 56, thus, preventing leakage of the combustion gases 30 through the casing holes 55 and the casing 36. The washer 94 should be made from a material with a higher coefficient of thermal expansion than the strut 40 and base 54 which it is press fit into. The difference in thermal expansion will assure that the washer interference with the hole counterbore 80 is always present during engine operation. One advantage of the present invention is that it enables the hole counterbore 80 and threads on the inner and outer threaded surfaces 86 and 88 to be machined from radially outboard of the casing 36, a more accessible side of the outer strut end 41. This is a more producible and less costly design of the turbine frame. The inserts are installed from radially outboard of the casing 36. Referring to FIGS. 5 and 6, insert keys 120 are radially disposed through aligned radially extending matched key insert hole slots 122 in the insert 84 and hole slots 124 along the inner portion 90 of the casing holes 55 respectively. The insert keys 120 are trapped in place by the washer 94 which prevents them from backing out due to engine vibration. The washer has tight tolerance diameter and concentricity requirements and this helps the washer take circumferential and axial loads through the struts and transfer them to the annular stiffening ribs 72 on the casing 36.

Another advantage of the present invention is that the washer will encounter the majority of the assembly/disassembly wear. The washer material has a lower hardness than the outer case and will yield/wear before the case if the parts are not aligned during assembly or they are distorted from long term operation. If the washer wears beyond desired limits, it can be easily replaced at a relative low cost as compared to prior art frame assemblies.

As an example of the method of the present invention reference may be had to a GE90 Turbine Center Frame (TCF) outer strut end which is connected to the outer casing by eight shear bolts at each of the twelve strut ends. To minimize relative movement between the case and strut end the shear bolt is used at each location. During manufacture each strut is placed in its assembled position relative to the casing 36 and each pair of the casing holes 55 collar mounting holes 56 is machined through the casing and the strut base 54 in a single pass to assure concentricity between holes in the casing and strut base and that they aligned properly during assembly. The struts are then separated from the casing and each previously machined through collar mounting hole 56 is used as a pilot to machine the counterbore 80 though the radially outer portion 82 of the collar hole to a specified depth relative to a reference plane on the strut end for subsequent thread tapping and insert installation. The radially inner portion 90 of the collar mounting hole 56 is then enlarged and threaded with a tapping procedure. The threaded hollow insert 84 is self broaching and keyed, having at least one key to prevent unwanted rotation. The threaded hollow insert 84 is installed flush with the bottom 102 of the counterbore 80 and the outer threaded surfaces 88 is screwed into the threaded radially inner portion 90 of the collar mounting hole 56. The washer 94 is then press fit into the counterbore 80 and retained by the counterbore bottom 102. Once all inserts and washers have been installed, the outer casing is assembled on to the outer strut ends 41. The bolts 58 are then installed through the casing holes 55 and threaded into the inserts 84.

Figure 8:
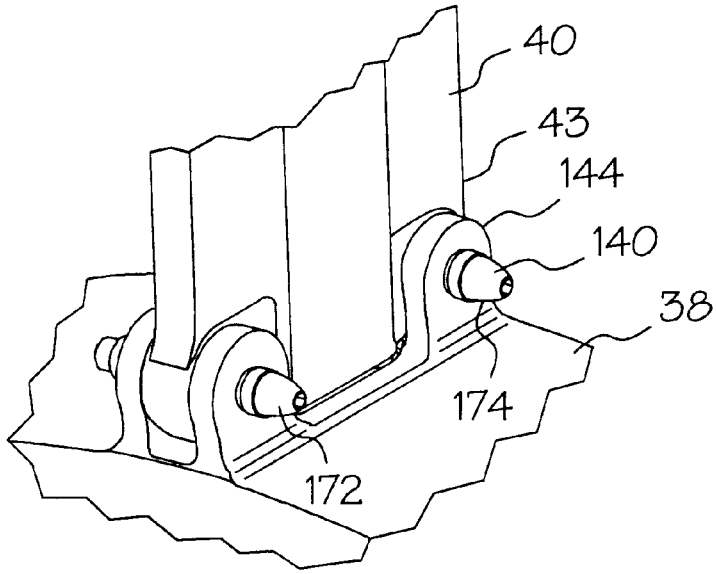
FIG. 8 is a radially inwardly looking perspective view illustration of a radially inner end of the strut and hub in FIG. 2.
Figure 9:
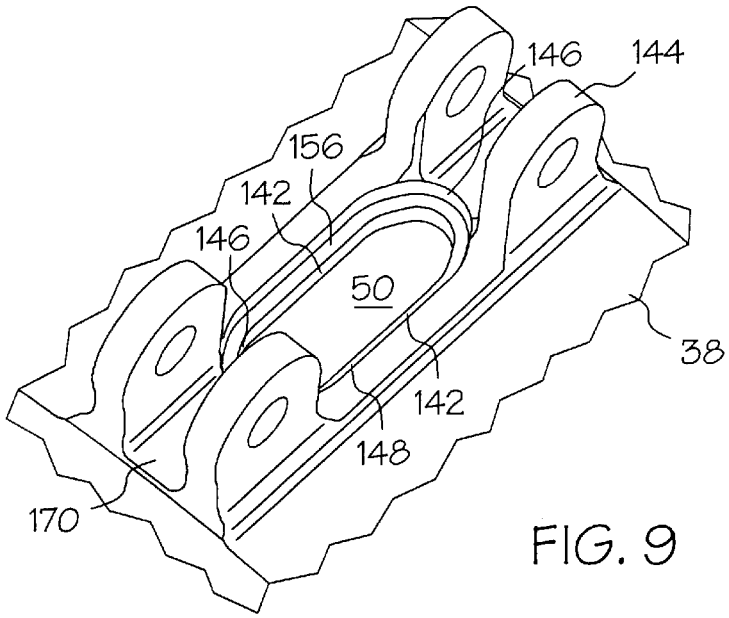
FIG. 9 is a radially inwardly looking perspective view illustration of the hub in FIG. 8 with the radially inner end of the strut removed.
Figure 10:
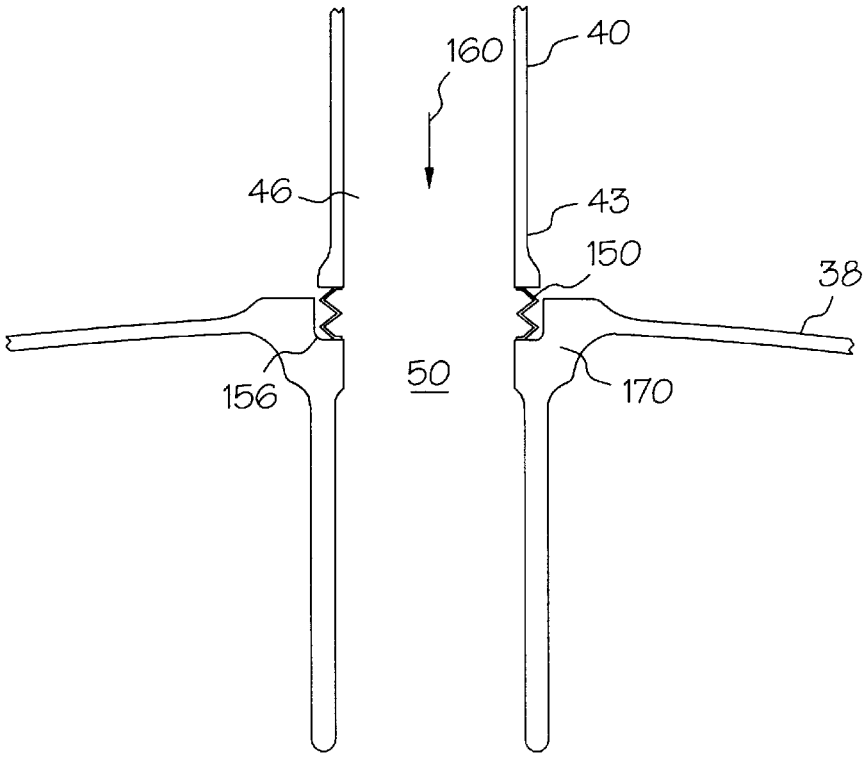
FIG. 10 is a diagrammatic cross-sectional perspective view illustration of the hub and the radially inner end of the strut and hub in FIG. 2.

Referring to FIGS. 1, 2, and 8, the inner end 43 of each of the struts 40 is removably connected to the hub 38 of the frame 32. In the exemplary embodiment illustrated herein expandable bolts 140 are used to connect the inner end 43 to radially outwardly extending devises 144 mounted on the casing 36 as shown more particularly in FIG. 9. The through channel 46 of the strut 40 is aligned with the first port 50 on the hub 38. A racetrack shaped hub counterbore 148 is machined into the base 54 around the second ports 50. A seal 150, illustrated in FIG. 10, is disposed between the inner end 43 and a shoulder 156 of the hub counterbore 148 thereby sealing off any leakage of pressurized cooling air 160 from the hollow through channel 46 between the inner end 43 of each of the struts 40 and the hub 38 of the frame 32. The seal 150 in the exemplary embodiment illustrated herein is metallic and deformable, and is able to withstand and function at temperatures up to 1000 degrees Fahrenheit. The racetrack shaped hub counterbore 148 is characterized by spaced apart straight parallel sides 142 disposed between rounded ends 146. In the exemplary embodiment illustrated herein the rounded ends are 146 are semi-circular.

The racetrack shaped hub counterbore 148 is machined into the hub 38 at each strut end connection location 170. The seal 150 is placed in the hub counterbore 148 using hand pressure. The seal 150 is bowed slightly outward at new part manufacture so that it is retained in the hub counterbore 148 in the absence of the strut 40. This aids in the assembly of the struts 40 to the hub 38. The strut 40 is attached to the hub 38 by first installing a forward one 172 of the expandable bolts 140 then rotating the strut about the forward bolt thus compressing the seal 150 between the strut and hub and then installing an aft one 174 of the expandable bolts. The expandable bolts are then torqued within a specified tolerance. Once the seal 150 is installed, a portion of the seal is visible allowing assembly personal to verify the seal is present. The seal is designed to function properly regardless of assembly orientation within the cavity (i.e. the seal can be installed upside down). Due to manufacturing tolerances, the gap between the strut end and hub counterbore can vary from frame to frame and from strut to strut within a given frame. The seal is designed to function properly (meet maximum leakage limits) given the variety of gaps. The seal will also function properly if it is initially installed into a cavity of minimum gap and later installed into a cavity of maximum allowable gap. Leakage between the strut and hub is minimized to acceptable levels. Manufacturing tolerances of the strut and hub are accommodated by the deformable nature of the seal. The seal will function properly regardless of assembly orientation, is reusable at other strut locations, and on other similar turbine center frames. Once installed, visual access exists to verify the a seal is present.

While there have been described herein, what are considered to be preferred and exemplary embodiments of the present invention, other modifications of the invention shall be apparent to those skilled in the art from the teachings herein and, it is, therefore, desired to be secured in the appended claims all such modifications as fall within the true spirit and scope of the invention.

Accordingly, what is desired to be secured by Letters Patent of the United States is the invention as defined and differentiated in the following claims.

What is claimed is:

1. An annular turbine frame comprising:

a ring disposed coaxially about an axial centerline axis and having a plurality of circumferentially spaced apart ports;

a plurality of circumferentially spaced apart struts joined radially to said ring by devises on said ring, each strut having radially opposite first and second ends, and a through channel extending therebetween; and each of said channels aligned with a corresponding one of said ports;

each of said ports has a port counterbore though a radially outer portion of said port forming a shoulder in said port; and a seal is disposed within said port counterbore between said shoulder and said strut.

2. An annular turbine frame as claimed in claim 1 wherein said port counterbore is racetrack shaped having parallel sides extending between rounded ends.

3. An annular turbine frame as claimed in claim 1 wherein said seal is metallic and deformable.

4. An annular turbine frame as claimed in claim 3 wherein said seal withstand and function at temperatures up to 1000 degrees Fahrenheit.

5. An annular turbine frame comprising:

a ring disposed coaxially about an axial centerline axis and having a plurality of circumferentially spaced apart ports;

a plurality of circumferentially spaced apart struts joined radially to said ring by bolts, each strut having radially opposite first and second ends, and a through channel extending therebetween; and each of said channels aligned with a corresponding one of said ports;

each of said ports has a port counterbore though a radially outer portion of said port forming a shoulder in said port; and a seal is disposed within said port counterbore between said shoulder and said strut.

6. An annular turbine frame as claimed in claim 5 wherein said port counterbore is racetrack shaped having parallel sides extending between rounded ends.

7. An annular turbine frame as claimed in claim 5 wherein said seal is metallic and deformable.

8. An annular turbine frame as claimed in claim 7 wherein said seal withstand and function at temperatures up to 1000 degrees Fahrenheit.

9. An annular turbine frame as claimed in claim 5 wherein said circumferentially spaced apart struts are joined radially by said bolts to devises on said ring.

10. An annular turbine frame as claimed in claim 9 wherein said port counterbore is racetrack shaped having parallel sides extending between rounded ends.

11. An annular turbine frame comprising:

a radially outer structural ring disposed coaxially about an axial centerline axis and having a plurality of circumferentially spaced apart first ports extending radially therethrough, a radially inner structural ring disposed coaxially about said centerline axis, spaced radially inwardly from said outer structural ring, and having a plurality of circumferentially spaced apart second ports extending radially therethrough, a plurality of circumferentially spaced apart struts joined to said outer and inner structural rings, each of said struts having radially opposite inner and outer ends and a through channel extending therebetween; and said channel aligned with a corresponding one of said first and second ports;

each of said second ports having a port counterbore though a radially outer portion of said second ports forming a shoulder in said second ports; and a seal disposed within said port counterbore between said shoulder and said inner end of said strut.

12. An annular turbine frame as claimed in claim 11 wherein said circumferentially spaced apart struts are joined radially by bolts to said inner ring.

13. An annular turbine frame as claimed in claim 12 wherein said circumferentially spaced apart struts are joined radially by said bolts to devises on said inner ring.

14. An annular turbine frame as claimed in claim 13 wherein said port counterbore is racetrack shaped having parallel sides extending between rounded ends.

15. An annular turbine frame as claimed in claim 14 wherein said seal is metallic and deformable.

16. An annular turbine frame as claimed in claim 15 wherein said seal withstand and function at temperatures up to 1000 degrees Fahrenheit.

17. An annular turbine frame as claimed in claim 11 wherein said seal is metallic and deformable.

* * * * *